United States Patent [19]

McClellan

[11] Patent Number: 4,799,955

[45] Date of Patent: Jan. 24, 1989

[54] SOFT COMPOSITE METAL POWDER AND METHOD TO PRODUCE SAME

[75] Inventor: Melvin L. McClellan, Beaver Falls, Pa.

[73] Assignee: Elkem Metals Company, Pittsburgh, Pa.

[21] Appl. No.: 105,274

[22] Filed: Oct. 6, 1987

[51] Int. Cl.[4] ..... B22F 1/00

[52] U.S. Cl. ..... 75/247; 75/246; 75/251; 75/255; 419/31; 419/32; 419/33; 419/61; 419/62; 419/66

[58] Field of Search ..... 75/251, 255, 246, 247; 419/31, 32, 33, 61, 62, 66

[56] References Cited

U.S. PATENT DOCUMENTS

| | | | |
|---|---|---|---|
| 3,785,801 | 1/1974 | Benjamin | 75/0.5 BC |
| 4,158,719 | 6/1979 | Frantz | 419/19 |
| 4,253,874 | 3/1981 | Cundill | 75/246 |
| 4,619,699 | 10/1986 | Luton et al. | 75/252 |
| 4,627,959 | 12/1986 | Gilman et al. | 419/61 |

*Primary Examiner*—Stephen J. Lechert, Jr.
*Attorney, Agent, or Firm*—Lucas & Just

[57] ABSTRACT

Disclosed is a composite metal powder made from a base iron powder milled with an alloying component such as nickel, copper, managnese, chromium, silicon, phosphorus, boron, vanadium, and molybdenum, where the composite metal powder has a compressibility comparable to the compressibility of the soft base iron powder prior to milling. Such a composite is obtained by using a short mill time followed by an annealing step.

16 Claims, No Drawings

SOFT COMPOSITE METAL POWDER AND METHOD TO PRODUCE SAME

This invention relates to powder metallurgy and, more specifically, to a new composite metal powder made from a base iron powder and an alloying component where the composite metal powder has a compressibility similar to the base iron powder prior to forming the composite and the alloying component is embedded in the base iron powder.

Compressibility is a standard measurement described in ASTM B 331, "Compressibility of Metal Powder in Uniaxial Compaction", and is a measure of the density achieved when pressing a powder into a die at a specified pressure. The higher the compressibility the lower energy needed to produce a powder metal part and the denser the part will be. Among other characteristics, it measures the hardness of the powder.

Metal powders are used in powder metallurgy to form hardened metal objects such as gears and rods by first pressing the powder in a die and then heating the compacted metal powder to form a coherent mass. The heating step is referred to as sintering. Sintering is typically defined as the bonding of particles in a mass of metal powder by molecular or atomic attraction through the application of heat at a temperature below the melting point of the metal.

Conventionally, metal powders used in powder metallurgy are either an alloy metal powder which has been milled to the point of saturation hardness or a loose mixture of two or more individual metal powders. Loose mixtures of individual metal powders are formed by the manufacturer who buys the individual metal powders. The loose mixture is formed using a conventional mixing apparatus. Such loose mixtures of metal powders have poor dispersion of the alloying component and oxidation of the alloying component occurs prior to formation of the part. U.S. Pat. No. 3,785,801 issued Jan. 15, 1974 to J. S. Benjamin and all of its progeny teach the formation of alloy metal powder by prolonged milling of two or more metal powders. Typically, the milling period exceeds 48 hours. The alloy metal powder so produced has typically reached saturation hardness. Saturation hardness is a hardness value which does not increase with increased milling time. The use of such a hardened alloy metal powder produces a greater amount of wear on the die stock than using a mixture of soft base iron and alloy component. Additionally, such a hardened alloy metal powder does not produce as dense a part as the mixture of soft iron and alloy component.

Applicant has now discovered, quite unexpectedly, that by milling a mixture of base iron powder with an alloying component for a short period of time to form an intermediate milled product and then annealing the intermediate milled product, a composite metal powder is produced that has a compressibility similar to that of the base iron powder. It has also been found that the composite metal powder of the present invention has a good dispersion of the alloying component in the base iron powder, and is advantageous to use in the powder metallurgy process of forming hardened objects.

It is important that a good dispersion of the alloying component is obtained in the base iron powder in order to obtain a homogeneous hardened object. It has also been found that the dispersion is such with the metal composite of the present invention that it prevents separation of components in the powder state. This is also an important aspect in order to obtain an homogeneous hardened object.

Having a compressibility similar to the compressibility of the base iron powder means that the composite metal powder of the present invention produces a denser part before sintering than conventional alloy metal powders. In fact, it has been found that the compressibility of the metal powder composite of the present invention is similar to the compressibility of the base iron powder. Having such a high degree of compressibility means that the composite metal powder of the present invention decreases the wear on the compressing dies and increases the life of the dies used in the process of forming the hardened object. This provides an economic advantage to the user of the metal composite powder of the present invention.

Yet another advantage of the present invention is that the alloying component is embedded in and often fully encapsulated in the soft base iron powder. This protects the alloying component from oxidation. This embedding aspect is also thought to aid in preventing separation of the components in the composite metal powder.

Broadly, the method of the present invention entails milling a base iron powder with an alloying component for a sufficient period of time to embed the alloying component in the base iron powder thereby forming an intermediate milled product and subsequently annealing the intermediate milled product to form a composite metal powder having compressibility similar to the compressibility of the base iron powder.

The base iron powder can be mixed with the alloying component prior to its addition to the mill or the base iron powder and alloying component can be added individually to the mill. Premixing is preferred.

Milling of the base iron powder and the alloying component to produce the intermediate milled product of the present invention can be conducted in any conventional mill used in the powder metallurgy field that produces an intermediate milled product that can be annealed to form the composite metal powder of the present invention. Dry, intensive, high energy milling used in the present invention is not restricted to any type of apparatus. Typically, a high energy ball type mill is used such as a stirred ball mill, a shaker ball mill, a vibrating ball mill or a planetary ball mill. An attritor can be used. An attritor is a high energy ball mill in which the powder charge is agitated by an impeller located therein. The motion to the balls is imparted by the impeller. Good results have been obtained with a vibrating ball mill of the type sold under the tradename SPEX shaker mills.

When using a mill that employs balls, a ball to powder weight ratio of about 5:1 to about 50:1 can be used. Good results have been obtained when using a ball to powder weight ratio of about 10:1.

The atmosphere inside the mill should be controlled and preferably the atmosphere inside the mill is a non-oxidizing atmosphere. Good results have been obtained with an atmosphere of inert gas such as nitrogen, helium, or argon, with argon being preferred.

The milling temperature should be ambient. Due to the heat generated by the moving powder and balls, typically the mill is jacketed and provided with a cooling medium to maintain the temperature at ambient.

Typically, the milling process is a batch operation where the components are milled, recovered from the mill, and screened for size. The intermediate milled product that does not meet the size criteria is recycled.

The time of the milling will vary depending on the parameters of the type of milling process used and the amount of base iron powder and alloying component in the mill. Using a SPEX shaker mill with 100 grams of ¼-inch diameter steel balls with a ball to powder ratio of 10:1 by weight operated at 1200 cycles per minute for a period of between about 40 to 60 minutes produces good results. The milling period in such an operation can be for about 15 to about 90 minutes and more preferred about 20 to 80 minutes with a most preferred mill time of about 40 to about 60 minutes.

Using a vertical attritor mill operated at an impeller speed of 60 rpm and containing a ball load of ¼-inch diameter steel balls weighing 15 Kg, and a weight ratio of balls:powder being about 10:1, a period of about 4 to about 8 hours produces good results.

The milling period is best determined by microscopic inspection of milled product to determine when the milled mixture of base iron powder and alloying component has formed an intermediate milled product that can be annealed to form the composite metal powder of the present invention.

Typically the particles of base iron powder and alloying component when initially introduced into the mill are flattened when initially milled. The intermediate milled product of the present invention has particles that are rounded in shape. Milling of the flat plate-like particles is continued until a rounded intermediate milled particle is produced that has the alloying component embedded in the base iron matrix and more preferably until the alloying component is fully encapsulated in the base iron matrix. The milling period has lasted too long when the rounded composite has fractures appearing therein and starts to work harden excessively. The process is discontinued when the rounded particles are produced and fracturing of the particles appears to be beginning. The alloying component particles in the composite is readily detectable by optical means. Subsequent milling, if allowed to proceed past this point, results in extensive fracturing and finer particles sizes in the powder as the material rapidly work hardens. If allowed to continue for several hours, a mechanical alloyed product would result, and saturation hardness of the powder would occur.

The milling period lasts long enough to embed the alloying component particles into the soft base iron matrix and more preferably until the alloying component particles are fully encapsulated in the soft base iron powder.

After milling, the intermediate milled product is subjected to an annealing step. Annealing is a process whereby the intermediate milled product is heated to a temperature of between about 500° C. to about 1000° C. for a period between about 8 hours to about 5 minutes in an inert atmosphere. Such annealing removes any work hardening that occurred to the intermediate milled product and produces a soft composite metal powder that has a compressibility similar to the compressibility of the soft base iron matrix prior to milling.

The milling step lasts too long when the annealing step cannot produce a composite with a compressibility similar to the compressibility of the base iron matrix.

The annealing step is carried out using conventional equipment. Preferably, an inert atmosphere is used in the annealing chamber. Preferably an inert gas or vacuum is used. More preferably the atmosphere is hydrogen gas.

The length of the annealing step is inversely proportional to the annealing temperature. At about 1000° C. about 5 minutes are needed, at about 500° C. about 6 hours are needed. Preferably the annealing step is run at about 850° C. for about 30 minutes.

The compressibility of the composite of the present invention is similar to the compressibility of the base iron powder prior to its addition to the mill. If the composite's hardness is too much higher than the base iron powder, then the composite, although useful in powder metallurgy, will produce low density green parts and not be the product of the present invention. Preferably the compressibility of the composite of the present invention is substantially similar to that of the base iron powder.

When the composite metal powder of the present invention has a similar compressibility to the base iron powder, the ratio of compressibility of composite metal powder to compressibility of base iron powder is equal to or greater than about 95% (compressibility of composite metal powder/compressibility of base iron). Preferably the ratio of compressibility of the composite metal powder to base iron powder is substantially similar, i.e. equal to or greater than about 98%.

This invention produces a suitable composite metal powder for use in pressing and sintering low alloy steel parts. The composite metal powder of the present invention comprises a soft iron matrix or base iron powder with alloying component particles grossly dispersed therein, but not alloyed, throughout the base iron matrix. The composite metal powder has compressibility similar to that of the soft iron powder which is much softer than pre-alloyed or mechanically alloyed metal powders. The composite of the present invention has the alloying component contained, at least in part, in the interior of the base iron powder, thereby protecting the alloying component from unfavorable atmospheres. This permits the use of conventional alloys such as manganese and chromium which are not presently enjoying wide application. Additionally, the method of the present invention prevents the segregation that is experienced when using elemental blends of powdered metals. Also, pressing dies are protected from wear caused by hard alloy particles, thereby decreasing the wear on the dies.

The alloying components suitable for use in the present invention include nickel, copper, manganese, chromium, silicon, phosphorus, boron, vanadium and molybdenum.

One or more of the alloying components can be added to make the composite metal powder of the present invention.

The amount of each alloying component used to prepare the composite metal powder of the present invention will vary depending on the desired proportions of each alloying component in the final product. Typically, the composite metal powder of the present invention will be prepared having less than about 2% by weight phosphorus, less than about 10% by weight silicon, less than about 1% by weight boron, less than about 2% by weight vanadium, less than about 2% by weight molybdenum, less than about 10% by weight manganese, and less than about 12% by weight of chromium.

The exact proportions can be such that the composite metal powder of the present invention has a composition comparable to commercial steel such as steel designed by AISI-SAE designations 41XX and 51XX. The 41XX steel series generally has about 0.5% to 1.0% Maganese, 0.8% to 1.1% chromium and about 0.15% to 0.25% molybdenum, the percents being by weight. The 51XX steel series generally has between about 0.8 to 1.05% by weight chromium and 0.6% to 0.9% Manganese.

Any conventional source of the alloying component can be used.

The base iron powder used in the present invention can be from any conventional source. Typically, the base iron powder is made up of about 98% iron and about 0.2% carbon. Like the alloying components, the exact make-up of the base iron powder component can vary depending on the desired finished compound. Preferably the base iron powder is low in carbon, having a carbon content of less than about 0.1% by weight and an iron content of about 99% by weight and above.

The particle size of the alloying component and the base iron powder prior to addition to the mill should be less than about 60 mesh; and preferably in the range of about 100 mesh to about 325 mesh. Good results have been obtained with an alloying component having a particle size of about 60 mesh by down and a base iron powder having a particle size of about 100 mesh by down.

It will be understood by those of skill in the art that some size reduction will naturally occur due to the milling process.

The present invention may be more fully understood by the following examples.

EXAMPLE 1

To 10 grams of soft iron powder of 99+% iron content and 0.8% carbon, 0.18 grams of ferrochrome alloy containing 56% chrome, 7% carbon, 3% silicon, and 0.1 grams of high-carbon ferromanganese containing 80% manganese and 6.5% carbon was mixed. These powders were added to a SPEX vibrating ball mill which had been purged with argon and the mill sealed with an argon atomosphere. The mill was operated for forty minutes with ¼-inch steel balls in a ball to powder ratio of 10:1. Upon discharge the milling had produced flowable iron powder with the alloying components dispersed as small particles throughout and completely embedded in the soft iron metal matrix. A flowable composite powder with a rounded morphology was produced.

EXAMPLE 2

This example illustrates the milling time.

| Time (mins.) | Results (microscopic observations) |
|---|---|
| 5 | High degree of size reduction of original powder; plate-like structure |
| 10 | Plate-like structure, low flowability |
| 20 | Regular and spherical morphology; few internal cracks |
| 40 | Spherical structure |
| 60 | Spherical structure |

This example was carried out using a SPEX shaker mill with 100 grams of ¼-inch diameter steel balls. The charge to the mill was reduced iron powder, ferrochromium and ferromanganese to obtain a composition of 98% by weight iron, 1% by weight chromium and 0.8% by weight manganese. A ball to powder ratio of 10:1 was employed. The milling was conducted in an argon atmosphere.

EXAMPLE 3

This example illustrates compressibility and the effect of excessive milling time.

A charge consisting of commercial iron powder weighing 1451.8 g sized 100 mesh×D 15.39 g of high carbon ferromanganese and 626.75 g of high carbon ferrochromium and 6.05 g of ferro molybdenum were preblended and milled in vertical attritor mill operating at an impeller speed of 60 rpm and containing a ball load of ¼-inch diameter steel balls weighing 15,000 g. An inert atmosphere of nitrogen was employed. Samples of the powder were removed after time intervals of 4, 8 and 16 hours. These samples were then annealed in hydrogen for 30 minutes at 850° C. Compressibility tests were then made at 100 Ksi with the following results:

| Sample No. | Sample Description | Compressibility | Compressibility Ratio Composite/Base |
|---|---|---|---|
| 1. | Initial iron powder prior to milling | 7.16 g/cc | — |
| 2. | Composite powder after 4 hrs. milling | 7.19 g/cc | 100 |
| 3. | Composite powder after 8 hrs. milling | 7.05 g/cc | 98 |
| 4. | Composite powder after 16 hrs. milling | 6.71 g/cc | 93.7 |

It is also understood that other systems using ductile and brittle elements can be used to produce unique powders by this method.

Sample Nos. 2 and 3 had compressibilities which were similar to the compressibility of the base iron matrix prior to milling, Sample No. 1. Sample No. 4 had an unacceptable compressibility and is outside the scope of the present invention. Sample No. 4 was milled too long to allow the annealing step to bring the compressibility back to the original.

It will be understood that the claims are intended to cover all changes and modifications of the preferred embodiments of the invention herein chosen for the purpose of illustration which do not constitute a departure from the spirit and scope of the invention.

What is claimed is:

1. A method for making a metal composite powder from a base iron powder and an alloying component comprising the steps of:

(a) milling said base iron powder and said alloying component for a period of time sufficient to embed said alloying component in said base iron powder to produce an intermediate milled product;

(b) annealing said intermediate milled product to produce a metal composite powder having a compressibility similar to that of said base iron powder prior to milling; and (c) recovering said metal composite powder.

2. The method of claim 1 wherein the milling step is conducted in a non-oxidizing atmosphere.

3. The method of claim 1 wherein the milling step is conducted in a high energy vibrating mill using ball to powder weight ratio of between about 5:1 to about 50:1.

4. The method of claim 1 wherein the milling step is conducted in an attritor mill with a ball to powder weight ratio of about 10: about 1 and the mill time is about 4 to about 12 hours.

5. The method of claim 1 wherein said annealing step is conducted at a temperature of between about 500 to about 1000° C. for a period of time between about 6 hours to about 5 minutes.

6. The method of claim 2 wherein the non-oxidizing atmosphere is an inert gas.

7. The method of claim 3 wherein the ratio of balls to powder is about 10:1.

8. The method of claim 3 wherein the milling time is about 15 minutes to about 90 minutes.

9. The method of claim 3 wherein the milling time is about 20 minutes to about 80 minutes.

10. The method of claim 4 wherein the milling step is conducted in a non-oxidizing atmosphere.

11. The method of claim 5 wherein said annealing step is conducted at a temperature of about 850° C. for a period of time of about 30 minutes.

12. A method for making a metal composite powder from a base iron powder and an alloying component comprising the steps of:

(a) milling said base iron powder and said alloying component in a high energy vibrating mill using a ball to powder weight ratio of about 10:1 for a period of between about 20 to about 80 minutes such that said alloying component is embedded in said base iron powder to form an intermediate milled product; and (b) annealing said intermediate milled product at a temperature of about 850° C. for a period of about 30 minutes.

13. A method for making a metal composite powder from a base iron powder and an alloying component comprising the steps of:

(a) milling said base iron powder and said alloying component in an attritor mill using a ball to powder weight ratio of about 10:1 for a period of between about 4 to about 8 hours such that said alloying component is embedded in said base iron powder to form an intermediate milled product; and (b) annealing said intermediate milled product at a temperature of about 850° C. for a period of about 30 minutes.

14. A composite metal powder for use in powdered metallurgy comprising:

(a) a base iron powder;

(b) an alloying component, said alloying component embedded in said base iron;

(c) said base iron powder and said alloying component being milled together such that said alloying component is embedded in said base iron powder thereby forming an intermediate milled product; and (d) said intermediate milled product being annealed such that said composite metal powder is formed that has a compressibility similar to the compressibility of said base iron powder.

15. The composite of claim 14 wherein the composite metal powder has a rounded shape when observed by optical means.

16. The composite of claim 14 wherein the alloying component is one or more components selected from the group consisting of nickel, copper, manganese, chromium, silicon, phosphorus, boron, vanadium, and molybdenum.

* * * * *